US011454100B1

(12) United States Patent
Choate

(10) Patent No.: US 11,454,100 B1
(45) **Date of Patent: *Sep. 27, 2022**

(54) ADJUSTABLE FRACTURING SYSTEM AND METHOD

(71) Applicant: Scott Choate, Austin, TX (US)

(72) Inventor: Scott Choate, Austin, TX (US)

( * ) Notice: Subject to any disclaimer, the term of this patent is extended or adjusted under 35 U.S.C. 154(b) by 18 days.

This patent is subject to a terminal disclaimer.

(21) Appl. No.: 17/007,465

(22) Filed: Aug. 31, 2020

(51) Int. Cl.

| | |
|---|---|
| ***E21B 33/068*** | (2006.01) |
| ***E21B 17/02*** | (2006.01) |
| ***E21B 43/26*** | (2006.01) |
| ***E21B 43/12*** | (2006.01) |
| ***E21B 34/14*** | (2006.01) |

(52) U.S. Cl.
CPC ..... *E21B 43/2607* (2020.05); *E21B 33/068* (2013.01)

(58) Field of Classification Search
None
See application file for complete search history.

(56) References Cited

U.S. PATENT DOCUMENTS

| | | | | |
|---|---|---|---|---|
| 6,003,604 | A * | 12/1999 | Wilkins | F16L 27/053 166/344 |
| 8,839,867 | B2 * | 9/2014 | Conrad | E21B 17/02 166/308.1 |
| 8,905,056 | B2 * | 12/2014 | Kendrick | F04D 13/12 137/15.01 |
| 8,978,763 | B2 * | 3/2015 | Guidry | F16L 27/12751 166/308.1 |
| 9,068,450 | B2 * | 6/2015 | Guidry | E21B 17/05 |
| 9,518,430 | B2 * | 12/2016 | Guidry | E21B 17/05 |
| 9,932,800 | B2 | 4/2018 | Guidry | |
| 10,094,195 | B2 | 10/2018 | Guidry | |
| 10,344,901 | B2 | 7/2019 | Penny et al. | |
| 10,480,300 | B2 * | 11/2019 | Guidry | E21B 43/26 |
| 10,487,637 | B2 | 11/2019 | Guidry | |
| 10,494,878 | B2 | 12/2019 | Scott et al. | |
| 10,995,561 | B1 * | 5/2021 | Travix | F16L 23/0286 |
| 11,066,913 | B2 * | 7/2021 | Guidry | E21B 43/2607 |
| 11,105,450 | B1 * | 8/2021 | Nguyen | F16L 27/0845 |
| 11,199,054 | B1 * | 12/2021 | Choate | E21B 43/2607 |
| 2012/0242081 | A1 * | 9/2012 | Keays | F16L 27/053 285/145.3 |
| 2016/0208571 | A1 * | 7/2016 | Themig | E21B 33/124 |
| 2019/0203862 | A1 * | 7/2019 | Ungchusri | F17D 1/14 |
| 2020/0277845 | A1 * | 9/2020 | Kajaria | E21B 43/26 |
| 2021/0198953 | A1 * | 7/2021 | Robinson | E21B 43/2607 |
| 2021/0372548 | A1 * | 12/2021 | Post | F16L 27/0849 |

* cited by examiner

*Primary Examiner* — Matthew Troutman
*Assistant Examiner* — Douglas S Wood

(57) ABSTRACT

An adjustable fracturing system is provided. In one embodiment, the adjustable fracturing system includes a fracturing flow control unit and a fracturing tree. A fracturing fluid conduit is coupled between the fracturing flow control unit and the fracturing tree to enable receipt of fracturing fluid by the fracturing tree from the fracturing flow control unit. Further, the fracturing fluid conduit is an adjustable fracturing fluid conduit composed of coupled offset pipe sections. The offset pipe sections are adjustable, allowing the offset pipe sections of the fracturing fluid conduit to vary a dimension of the fracturing fluid conduit to facilitate coupling of the fracturing fluid conduit between the fracturing flow control unit and the fracturing tree. Additional mechanisms, systems, and methods are also included.

14 Claims, 10 Drawing Sheets

ADJUSTABLE FRACTURING SYSTEM AND METHOD

BACKGROUND

The present disclosure relates in general to fracturing systems used in oil and gas exploration and production operations and, in particular, to an adjustable fracturing system. Oil and gas exploration requires complex industrial equipment to be interconnected at a well site in a precise manner. Typically, a drilling rig and wellhead is connected to a pump of some type to drive drilling operations. A particular site may have numerous wells that are drilled. To improve production at these sites, fluids may be pumped down these wells to fracture subterranean rock layers and thereby free oil and natural gas. This process is commonly referred to as hydraulic fracturing. Hydraulic fracturing produces fractures in the rock formation that stimulate the flow of natural gas or oil, increasing the volumes that can be recovered from a well. Fractures are created by pumping large quantities of fluids at high pressure down a well and into the target rock formation.

Hydraulic fracturing requires specialized equipment to pump fluids, at varying pressures, to the wells. This is conventionally done by a pump supplying fluids to the wellhead for selective delivery down the well. The fluids are conveyed from pumps to wellheads using interconnected mechanical networks of piping, commonly referred to as fracturing fluid conduits. In essence, the fracturing fluid conduits must provide flow paths for varying degrees of pressurized fracturing fluids. Fracturing fluid commonly consists of sand or proppant, water, and chemical additives that open and enlarge fractures within the rock formation. These fractures can extend several hundred feet away from the well bore. The sand, proppant, acids, or other small incompressible particles, hold open the newly created fractures, so that oil and natural gas can be extracted from the fractures.

Additionally, the wellhead may use a fracturing tree and other components to facilitate a fracturing process and enhance production from a well. A fracturing flow control unit may provide fracturing fluid to one or more fracturing trees via a fracturing fluid conduit. The fracturing flow control units and fracturing tress are typically large and heavy, and may be mounted to other equipment at a fixed location, making adjustments between the fracturing flow control unit and the fracturing tree difficult. The present invention relates to an adjustable fracturing system for use in hydraulic fracturing operations. For an example of an existing adjustable fracturing system, see U.S. Pat. No. 10,487,637, which is herein incorporated by reference in its entirety.

Existing adjustable fracturing systems do, however, have some problems. One problem with existing adjustable fracturing systems is that they tend to utilize a design where the fracturing fluid conduit is axially adjusted by a plurality of components using threaded parts, studs and nuts, and special sealing members to achieve a seal after the conduit adjustments are made. See, for example, the adjustable fracturing system described in U.S. Pat. No. 8,979,763 (hereinafter the '763 patent), which is herein incorporated by reference in its entirety. The various threaded components, along with the studs and nuts, are very time consuming adjustment mechanisms. Special sealing members are used to generate a seal once the conduit adjustment position is finalized. These special sealing members are expensive to manufacture, and in many cases, are not readily available.

Another problem with existing adjustable fracturing systems is that they tend to utilize a design where the fracturing fluid conduit is adjusted by a plurality of straight pipe sections connected to a plurality of ninety degree elbow connectors to achieve an assembled conduit system having freedom of movement in three directions. See, for example, the adjustable fracturing system described in U.S. Pat. No. 9,068,450 (hereinafter the '450 patent), which is herein incorporated by reference in its entirety. These adjustable fracturing systems have fracturing fluid conduits composed of a large number of individual components. These systems also require multiple ninety degree elbow connections, which individually change the direction of the flow path to achieve the required freedom of movement for the fracturing fluid conduit. Abrupt ninety degree changes in the flow path causes increased erosion on the component parts, and also decreases the coefficient of flow through the conduit, which leads to a loss of efficiency in fracturing fluid flow rates. These systems also require a large number sealing members to provide sealing between the straight pipe sections and the elbow connectors. Having a large numbers of sealing members results in an increase in the number of possible leak paths, which can be hazardous to the environment and operators.

In addition to the above-mentioned problems, adjustable fracturing systems can vary in quality in a number of ways. Different adjustable fracturing systems vary in their ability to attain high flow coefficients of flow, their performance reliability, their durability, their cost to manufacture, and their ease of use.

SUMMARY OF THE INVENTION

Embodiments of the present disclosure generally relate to adjustable fracturing systems having a fracturing flow control unit. In certain embodiments, an adjustable fracturing system includes a fracturing flow control unit coupled to one or multiple fracturing trees. Each fracturing tree can be coupled to the fracturing flow control unit via a fracturing fluid conduit between the fracturing flow control unit and the respective fracturing tree. In some instances, the fracturing fluid conduit between the fracturing flow control unit and the fracturing tree includes a large diameter bore pipe. The present disclosure generally relates to hydraulic fracturing using adjustable fracturing systems that facilitate alignment and coupling of a fracturing flow control unit with a fracturing tree via an adjustable fracturing fluid conduit. The invented adjustable fracturing system includes a fracturing fluid conduit consisting of a number of offset pipe sections with a number of angled connectors installed between each offset pipe section, wherein each offset pipe section has a primary bore connected to a secondary bore via an angled bore, and each offset pipe section is adjustable and provides freedom of movement in at least one direction in aligning the fracturing fluid conduit between a fracturing flow control unit and a fracturing tree.

In one embodiment of the invention, an adjustable fracturing fluid conduit includes a plurality of offset pipe sections coupled together by a plurality of angled connectors, wherein each offset pipe section is adjustable and functions to provide freedom of movement to the fracturing fluid conduit for coupling between a fracturing flow control unit and a fracturing tree. In another embodiment, an adjustable fracturing system includes a plurality of fracturing flow control units connected to a plurality of fracturing trees by a plurality of adjustable fracturing fluid conduits. In another embodiment, an adjustable fracturing fluid conduit includes a plurality of offset pipe sections coupled together by a single angled connector. In another embodiment, an adjustable fracturing system includes a single fracturing flow control unit, like a flow diverter, connected to a plurality of fracturing trees by a plurality of adjustable fracturing fluid conduits.

An adjustable fracturing system has been invented that addresses problems left unsolved by prior art adjustable fracturing systems. Namely, a new adjustable fracturing system has been invented that incorporates offset pipe sections into an adjustable fracturing fluid conduit, whereby adjustments to the offset pipe sections align the fracturing fluid conduit between a fracturing flow control unit and a fracturing tree. It has been discovered that an adjustable fracturing system utilizing a fracturing fluid conduit composed of sections of offset pipe coupled together with angled connectors, can create an adjustable fracturing system having fewer component parts while maintaining multiple directional freedoms of movement, along with a preferable means to adjust the fracturing fluid conduit between a fracturing flow control unit and a fracturing tree. An adjustable fracturing system has been invented that utilizes components with a simple rotational means of directional adjustment, while incorporating readily available sealing members. Also, an adjustable fracturing system has been invented with few abrupt changes in the flow path of the fracturing fluid conduit compared to existing adjustable fracturing systems, which reduces conduit erosion potential and increases the coefficient of flow through the fracturing conduit leading to an increase in efficiency in fracturing fluid flow rates. Furthermore, an adjustable fracturing system has been invented that requires few component parts, and thus requires few sealing members to provide sealing between components. Having a limited number of sealing members results in a decrease in the number of possible leak paths, which lowers the risk of possible leakage into the environment. The present invention is a vast improvement over the adjustable fracturing systems of the '763 and '450 patents.

In one aspect of the invention, an improved adjustable fracturing system designed for use between a fracturing flow control unit and fracturing tree is provided. An improvement on the system comprises the use of adjustable offset pipe sections that are coupled together with angled connectors in the form of a fracturing fluid conduit, wherein each offset pipe section provides freedom of movement in at least one direction. The novel use of one or more offset pipe sections, wherein each offset pipe section has a primary bore connected to a secondary bore via an angled bore, and with each offset pipe section providing freedom of movement in at least one direction in aligning the fracturing fluid conduit with a fracturing flow control unit and a fracturing tree.

In a second aspect of the invention, an improved adjustable fracturing system is provided. The new invention reduces the number of abrupt fracturing fluid conduit bends required to direct fracturing fluid flow between the fracturing flow control unit and the fracturing tree, which streamlines the fracturing fluid flow path and reduces fracturing fluid flow frictional losses due to changes in the fracturing fluid flow direction.

In a third aspect of the invention, an improved adjustable fracturing system is provided, wherein the new invention reduces the total number of fracturing fluid conduit components required to achieve the freedom of movement necessary for aligning the fracturing fluid conduit with the fracturing flow control unit and the fracturing tree. This is particularly important in operations involving multiple fracturing trees, since the new adjustable fracturing conduit will require multiples of fewer components. Fewer components in the fracturing fluid conduit will reduce the time required to adjust, assemble, and disassemble the adjustable fracturing system, resulting in less non-productive time, which increases the return on investment. Fewer fracturing fluid conduit components in the adjustable fracturing system will also reduce the costs associated with shipping, storing, and moving the adjustable fracturing system from one location to another. Fewer fracturing fluid conduit components also leads to a limited number of sealing members along the fracturing fluid conduit, resulting in a decrease in the number of possible leak paths.

The present invention provides the foregoing and other features, the advantage of the invention over prior art adjustable fracturing systems does become further apparent from the following detailed description of the embodiments, read in conjunction with the accompanying drawings. The detailed description and drawings are merely illustrative of the invention and do not limit the scope of the invention, which is defined by the appended claims and equivalents thereof.

DETAILED DESCRIPTION SPECIFIC EMBODIMENTS

Figure 1:
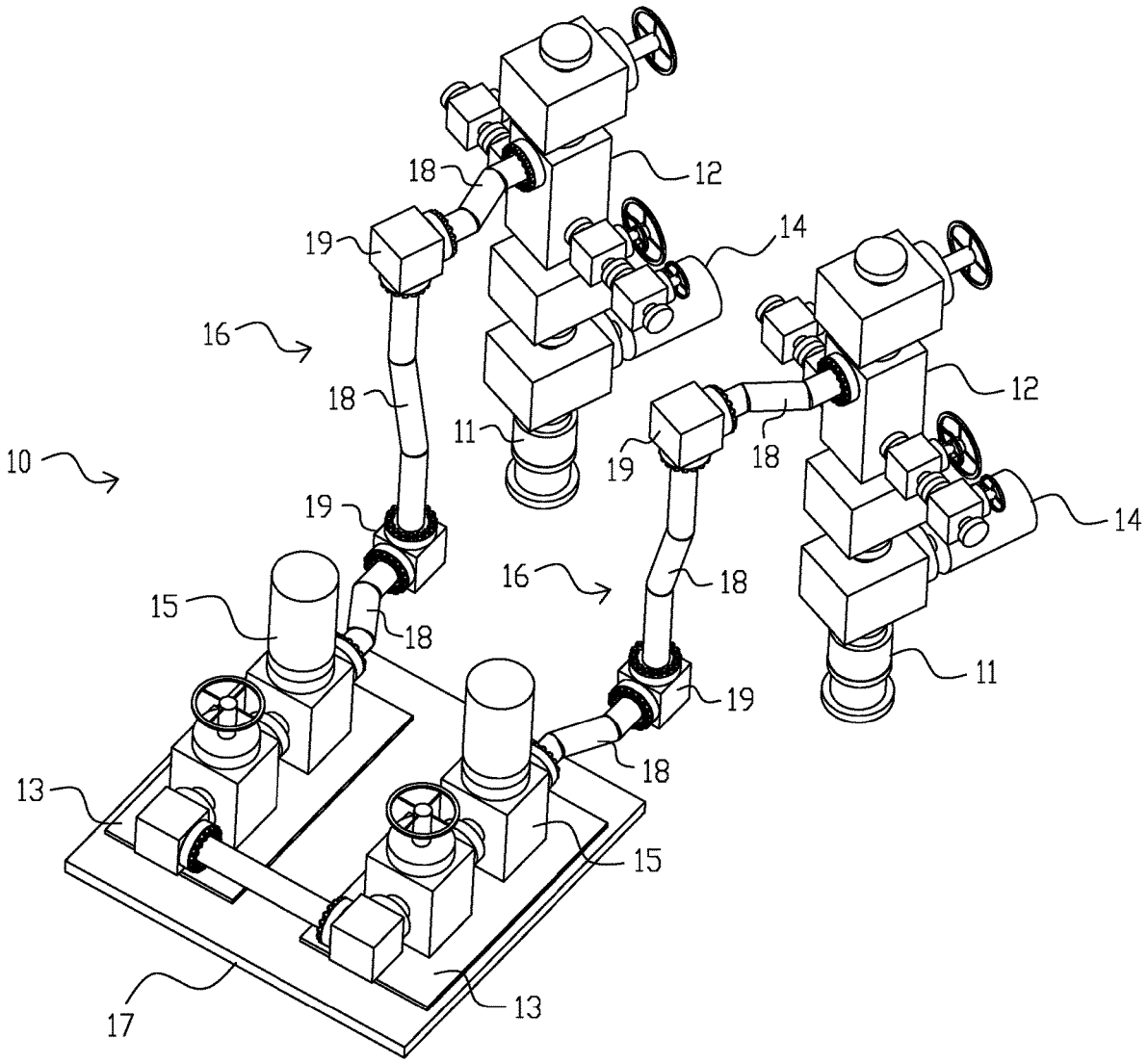
FIG. 1 is a perspective view of an adjustable fracturing system using fracturing fluid conduits composed of offset pipe sections with threaded flange end connectors and angled connectors, in accordance with an embodiment of the present disclosure.

An example of an adjustable fracturing system 10 is provided in FIG. 1 in accordance with one embodiment. The adjustable fracturing system 10 facilitates extraction of natural resources via a wellhead 11 and fracturing tree 12. By injecting fracturing fluid into the wellhead 11, the fracturing system 10 increases the number or size of fractures in a rock formation to enhance recovery of natural resources present in the formation. In the presently illustrated embodiment, the wellhead 11 is installed at the ground level, but it will be appreciated that natural resources may be extracted from other wellheads located on offshore platforms or on the sea floor.

The fracturing system 10 includes various components to control flow of the fracturing fluid into the wellhead 11. For instance, the adjustable fracturing system 10 includes a fracturing tree 12 and a fracturing flow control unit 13. The fracturing tree 12 includes at least one valve 14 that controls flow of the fracturing fluid into the wellhead 11. Similarly, the fracturing flow control unit 13 includes at least one valve 15 that controls flow of the fracturing fluid to the fracturing tree 12 by a fracturing fluid conduit 16.

The fracturing flow control unit 13 is mounted on a platform 17 to enable movement of the fracturing flow control unit 13 with respect to the ground. In FIG. 1, multiple fracturing flow control units 13 are connected to multiple fracturing trees 12 and multiple wellheads 11. It is noted that a single fracturing flow control unit 13 may be connected to a single fracturing tree 12 and single wellhead 11 when desired. In one embodiment, the fracturing flow control unit 13 has various valves 15 and the fracturing flow control unit 13 may be mounted on a platform 17. Numerous platforms 17 can be used to enable varying of the spacing between the flow control units 13. In some instances, this configuration allows for easier alignment of the fracturing fluid conduit 16 between the fracturing flow control unit 13 and the fracturing tree 12.

Referring to FIG. 1, an adjustable fracturing system 10 is shown in which fracturing fluid conduits 16 are adjustable to facilitate coupling of the fracturing fluid conduits 16 between the fracturing flow control units 13 and fracturing trees 12. In this embodiment, the adjustable components for the adjustable fracturing system 10 are provided in the form of offset pipe sections 18 and angled connectors 19 of the fracturing fluid conduits 16. The ability to the offset pipe sections 18 of the fracturing fluid conduits 16 to provide directional movement to the offset pipe sections 18 while being individually rotated, enables the fracturing fluid conduits 16 to be more easily positioned and connected between the fracturing flow control units 13 and the fracturing trees 12. In some instances, the offset pipe sections 18 and angled connectors 19 could be rotated to desired positions before assembling these components together. Although the offset pipe sections 18 are shown connected orthogonally to one another via the angled connectors 19 in the present embodiment, other embodiments could include offset pipe sections 18 connected to one another at different angles.

Figure 2:
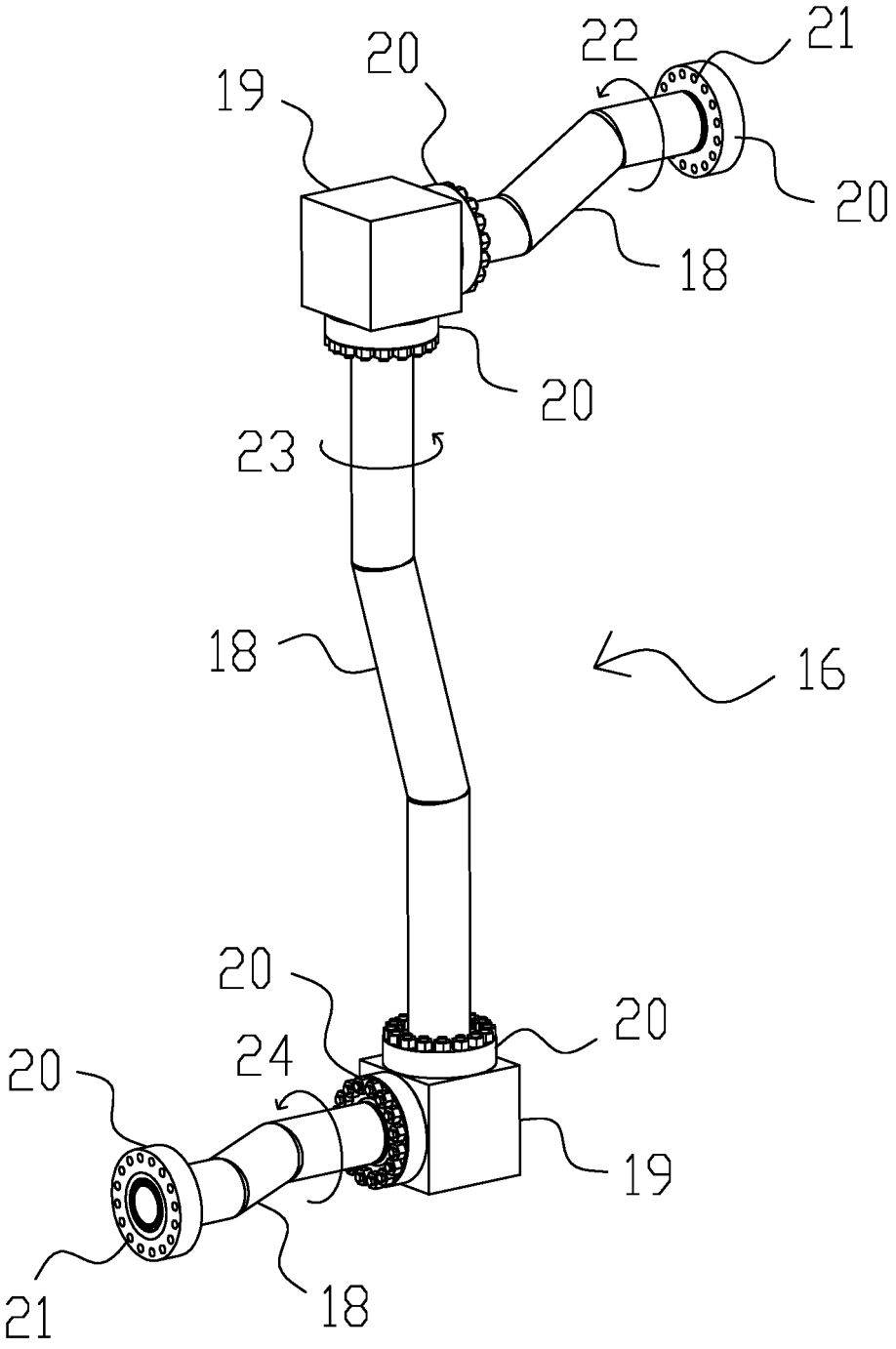
FIG. 2 is a perspective view of a fracturing fluid conduit composed of offset pipe sections with threaded flange end connectors and angled connectors, in accordance with an embodiment of the present disclosure.

Referring to FIG. 2, the fracturing fluid conduit 16 includes offset pipe sections 18 with threaded flange connectors 20 on each end that enables independent rotation of one offset pipe section 18 with respect to another offset pipe section 18. In this embodiment, the fracturing fluid conduit 16 includes a number of threaded flange connectors 20 that allow the offset pipe sections 18 and angled connectors 19 to rotate with respect to one another, which provides directional adjustment to the offset pipe sections 18 and thereby provides adjustment to the fracturing fluid conduit 16. As depicted, the threaded flange connectors 20 include through holes 21 to allow them to be connected to other components via studded connections. Other kinds of connections could also be used in accordance with the present technique. Various end connectors may be utilized with the offset pipe sections 18 in other embodiments.

Referring to FIG. 1 and FIG. 2, it can be seen that the threaded flange end connectors 20 enable the rotation of the offset pipe sections 18 and the angled connectors 19, as generally represented by arrows 22, 23, and 24. The threaded flange end connectors 20 at both ends of the offset pipe section 18 allows the offset pipe section 18 to be rotated about its primary bore axis, which causes movement of the secondary bore, which in turn changes the position of the angled connector 19. And through the rotation of the offset pipe sections 18, overall dimensions of the fracturing fluid conduit 16 can be changed to accommodate variances in distances and elevations between the fracturing flow control unit 13 and the fracturing tree 12. By rotating the various offset pipe sections 18 of the fracturing fluid conduit 16, the offset pipe sections 18 may be extended and retracted to position the fracturing fluid conduit 16 appropriately for coupling between the fracturing flow control unit 13 and the fracturing tree 12.

Figure 3:
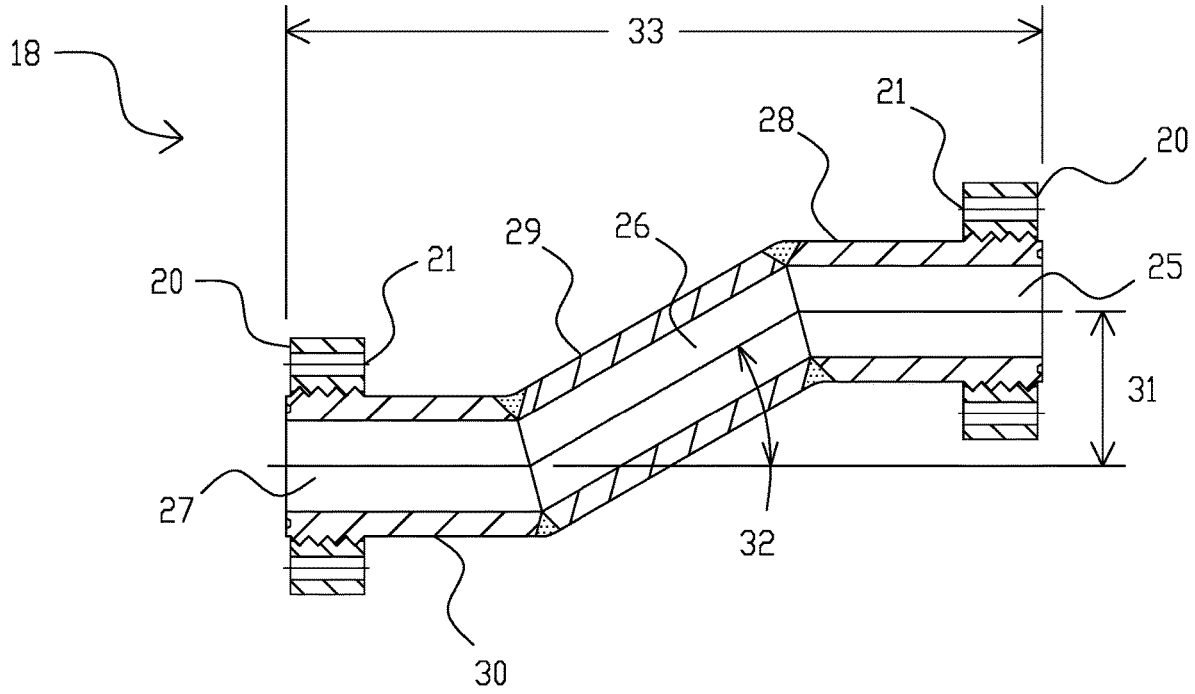
FIG. 3 is a cross sectional view of an offset pipe section with a threaded flange connector on each end, in accordance with an embodiment of the present disclosure.

Referring to FIG. 3, a cross sectional view of an offset pipe section 18 is shown with threaded flange end connectors 20 having through holes 21 on each end. The offset pipe section 18 is composed of a primary hub 28 connected to an angled pipe 29, which is connected to a secondary hub 30. Those of ordinary skill in the art understand the various ways of bending pipe to obtain an offset conduit or assembling a conduit by connecting the primary hub 28 to the angled pipe 29, and the angled pipe 29 to the secondary hub 30. For means of illustration only, the means of connection between components shown are weldments. Fracturing fluid flows through the offset pipe section 18 by entering a primary bore 25 of the primary hub 28, then the fracturing fluid enters an angled bore 26 of the angled pipe 29, then the fracturing fluid enters the secondary bore 27 of the secondary hub 30, and then the fracturing fluid exits the offset pipe section 18. The offset pipe section 18 has an overall length 33 with an offset angle 32 and an offset distance 31. The offset angle 32 is determined by the angle created between the secondary bore 27 centerline axis and the angled bore 26 centerline axis. The offset distance 31 is determined by the distance from the primary bore 25 centerline axis to the secondary bore 27 centerline axis. It should be noted that in order to achieve a reasonable amount of offset pipe section 18 adjustment, only a small offset angle 32 is required when coupled with the overall length 33. A small offset angle 32 will lessen the disruption of the fracturing fluid flow path and reduce erosion thorough the offset pipe section 16.

Figure 4:
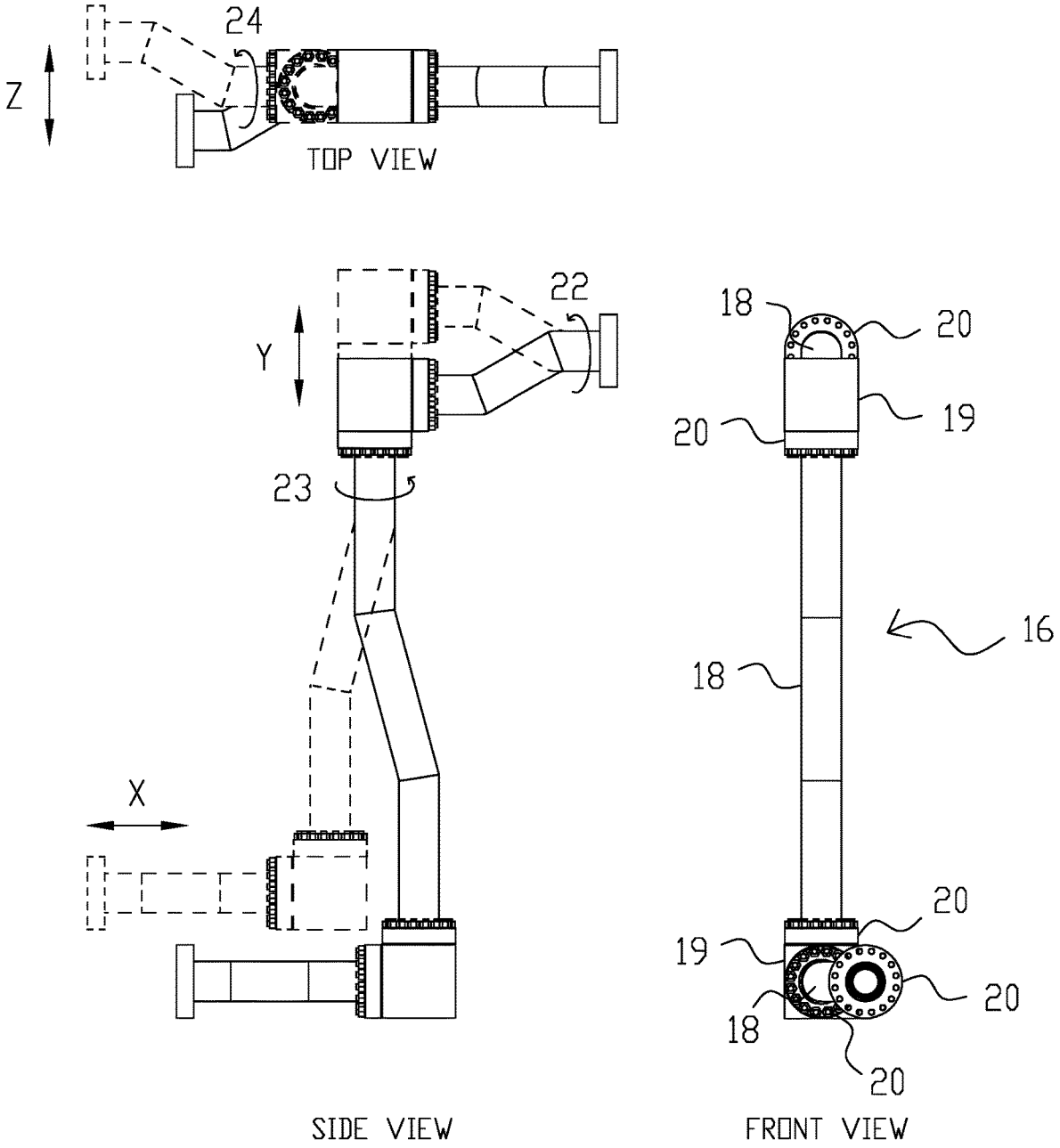
FIG. 4 shows various views of a fracturing fluid conduit composed of offset pipe sections with threaded flange end connectors and angled connectors showing directional movements resulting from offset pipe section rotations, in accordance with an embodiment of the present disclosure.

Referring to FIG. 4, a front view, side view, and top view of the fracturing fluid conduit 16 are shown. The fracturing fluid conduit 16 is composed of offset pipe sections 18 with threaded flange end connectors 20 and angled connectors 19. Adjustments to the fracturing fluid conduit 16 are accomplished by rotating a particular offset pipe section 18, which produces a desired directional movement in the offset pipe section 18. Rotation 22 produces a Y direction movement to the fracturing fluid conduit 16. Rotation 23 produces a X direction movement to the fracturing fluid conduit 16. Rotation 24 produces a Z direction movement. Note that the directions stated previously are for illustrative purposes only. A particular rotation can provide more than one particular direction of movement. For example, rotation 22 can also produce movement in the Z direction, rotation 23 can also produce movement in the Z direction, and rotation 24 can also produce movement in the Y direction. Any combination of rotations can be used to create the desired movement of the fracturing fluid conduit 18.

Figure 5:
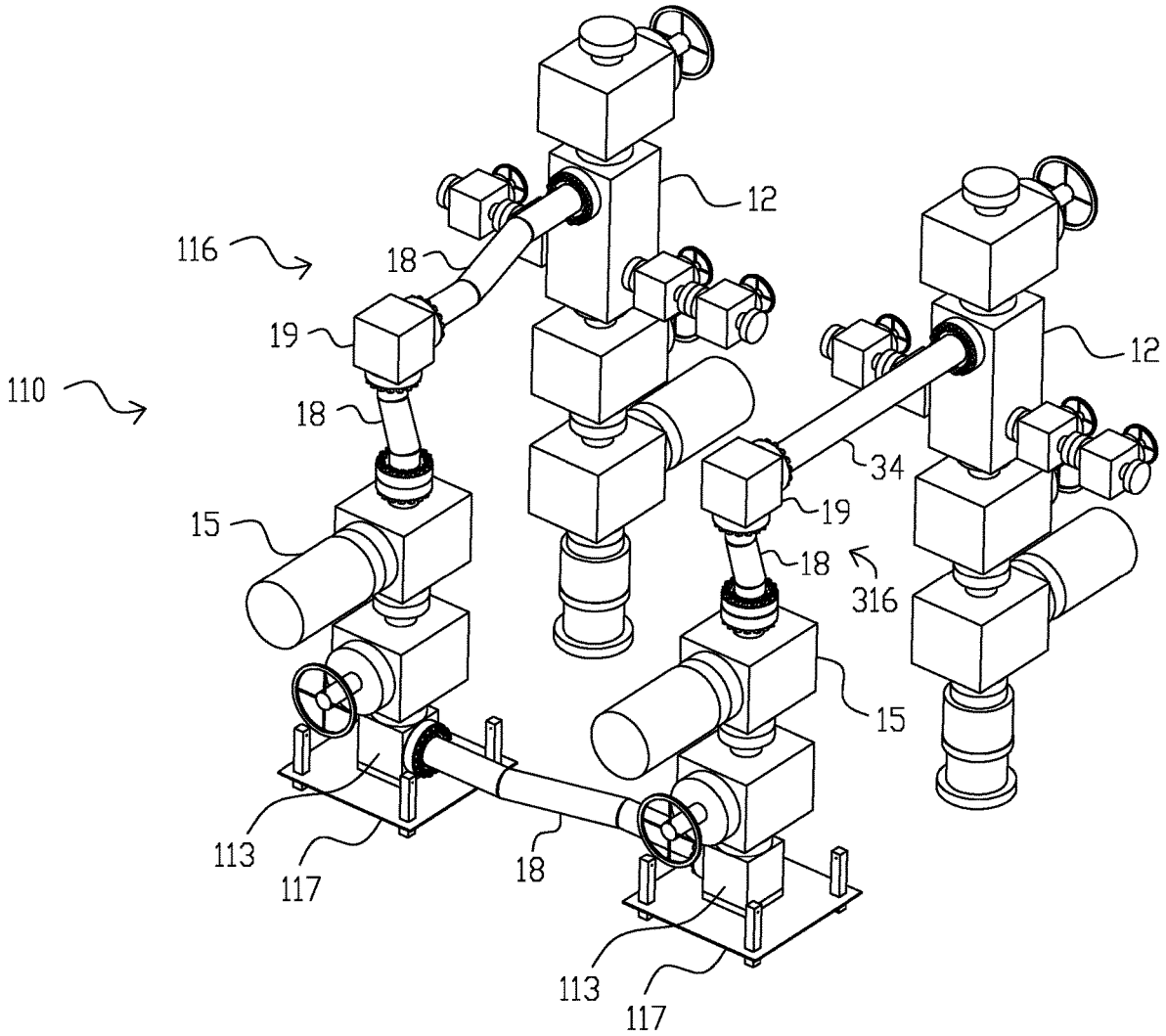
FIG. 5 is a perspective view of an adjustable fracturing system using fracturing fluid conduits composed of offset pipe sections with threaded flange end connectors and one angled connector located between a fracturing fluid control unit and a fracturing tree, in accordance with an embodiment of the present disclosure.

Referring to FIG. 5, an adjustable fracturing system 110 is shown in which fracturing fluid conduits 116 are adjustable to facilitate coupling of the fracturing fluid conduits 116 between the fracturing flow control units 113 and fracturing trees 12. In this embodiment, the fracturing flow control unit 113 has at least one valve 15 and is vertically mounted on an adjustable platform 117. The adjustable platform 117 allows users to vary the height of the fracturing flow control unit 113 to ease alignment with the fracturing tree 12 during installation of the fracturing conduit 18. In this embodiment, only one angled connector 19 is used in the fracturing fluid conduit 116 coupled between the fracturing flow control unit 113 and the fracturing tree 12. A second fracturing fluid conduit 316 uses a single straight pipe section 34 with an angled connector 19 and an offset pipe section 18. Using only one angled connector 19 streamlines the fracturing fluid flow path and reduces fracturing fluid flow frictional losses due to changes in the fracturing fluid flow direction. Furthermore, adjustable platform 117 height variation and movement can cause misalignment between the fracturing flow control units 113 on the adjustable platforms 117. In this case, one or more offset pipe sections 18 can be used to couple the fracturing flow control units 113 together, and provide adjustments that aid and simplify alignment between fracturing flow control units 113.

Figure 6:
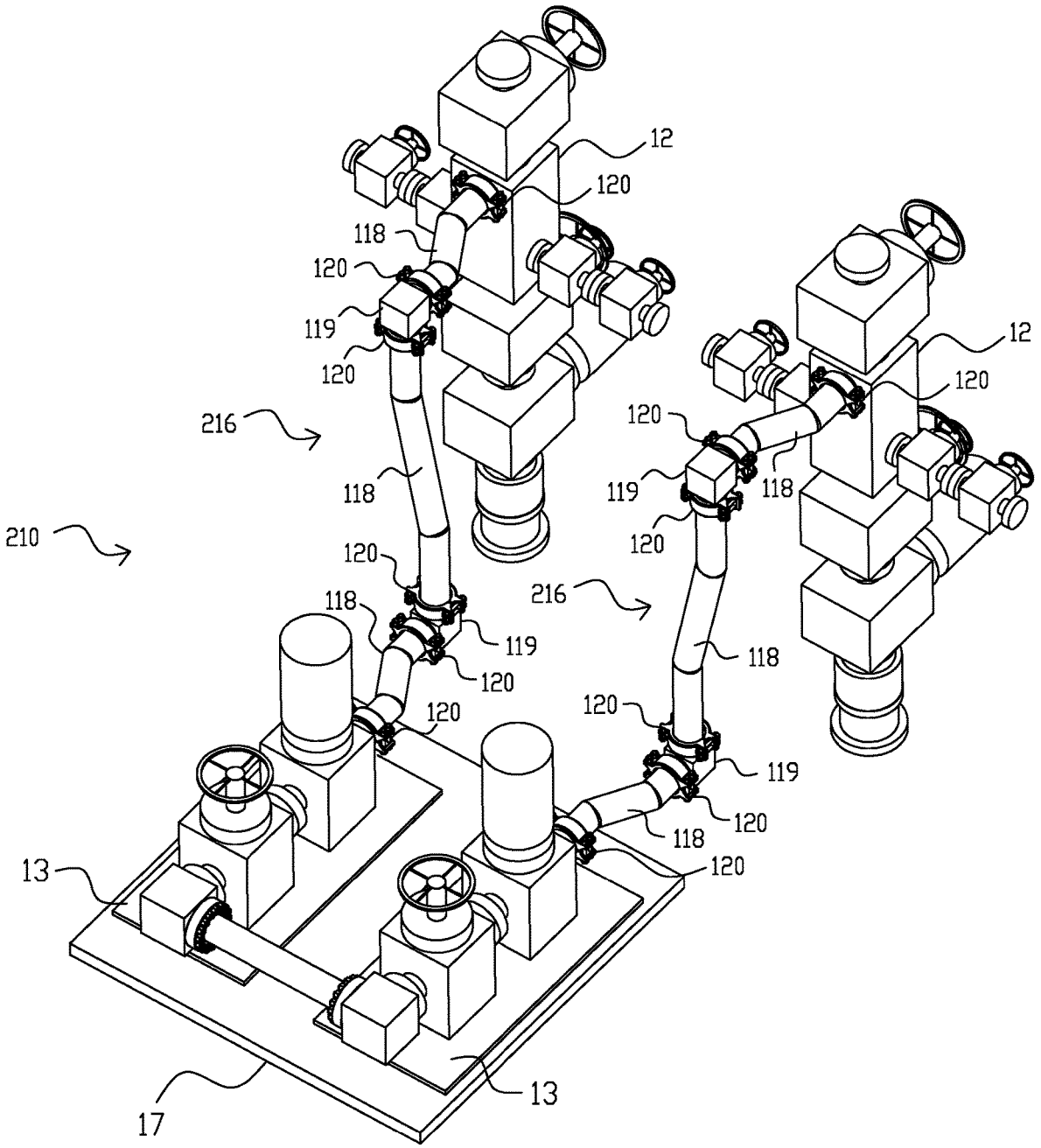
FIG. 6 is a perspective view of an adjustable fracturing system using fracturing fluid conduits composed of offset pipe sections with clamped end connectors and clamped end angled connectors, in accordance with an embodiment of the present disclosure.

Referring to FIG. 6, the adjustable fracturing system 210 is substantially identical to the adjustable fracturing system 10 in FIG. 1, except the adjustable fracturing system 210 includes fracturing fluid conduits 216 with a number of clamped hub end connectors 120 that allow the offset pipe sections 118 and clamped hub angled connectors 119 to rotate with respect to one another, which provides directional movement to the offset pipe sections 118 and thereby provides adjustment to the fracturing fluid conduit 216 to couple the platform 17 mounted fracturing flow control unit 13 to the fracturing tree 12.

Figure 7:
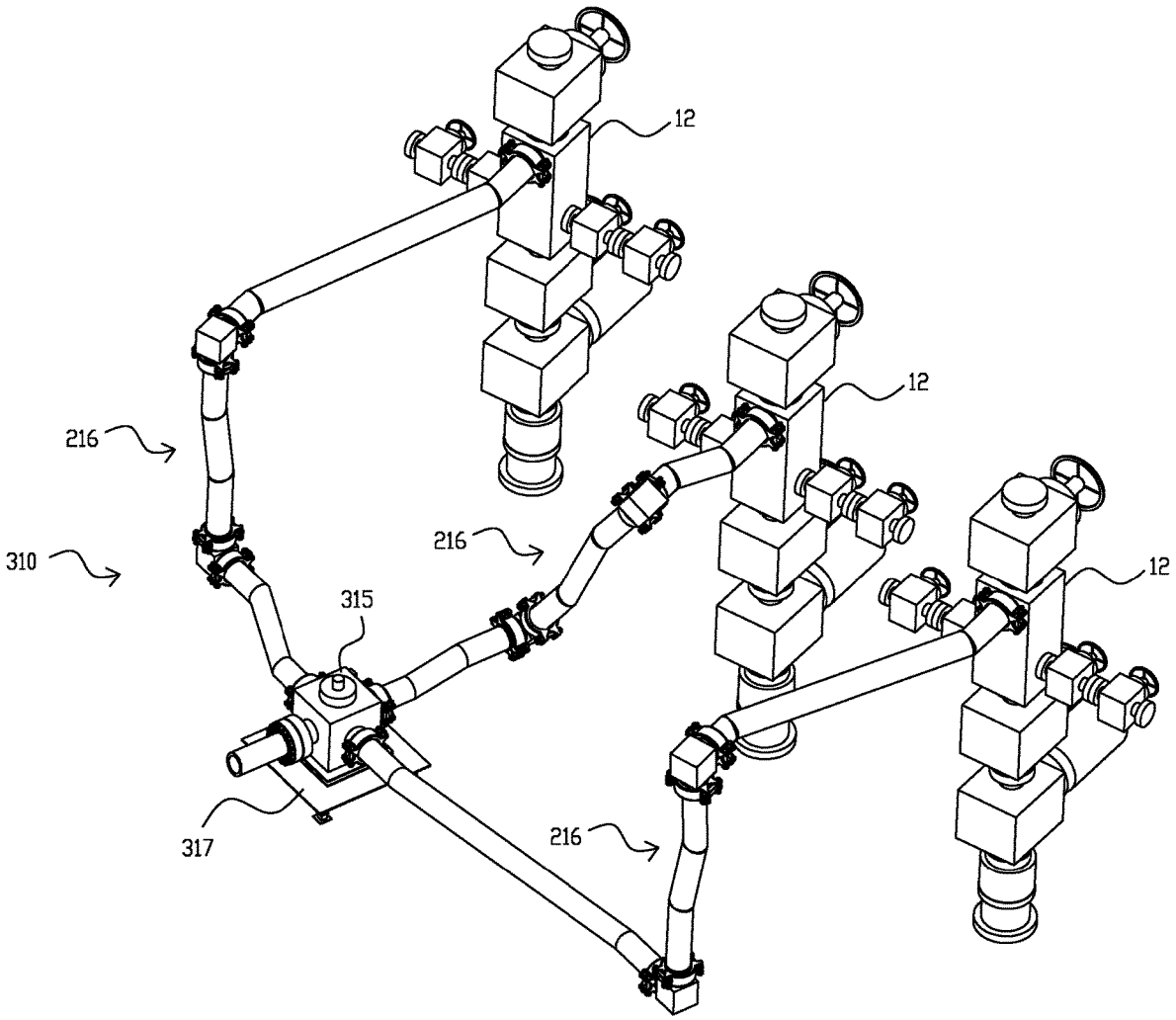
FIG. 7 is a perspective view of an adjustable fracturing system using fracturing fluid conduits composed of offset pipe sections, clamped end connectors, and clamped end angled connectors connecting a flow diverter to a fracturing tree, in accordance with an embodiment of the present disclosure.

Referring to FIG. 7, the adjustable fracturing system 310 is substantially identical to the adjustable fracturing system 210 in FIG. 6, except the adjustable fracturing system 310 utilizes a single fracturing flow control unit 315, such as a flow diverter, mounted to a platform 317. The single fracturing flow control unit 315 is connected to a plurality of fracturing trees 12 via a plurality of fracturing fluid conduits 216.

Figure 8:
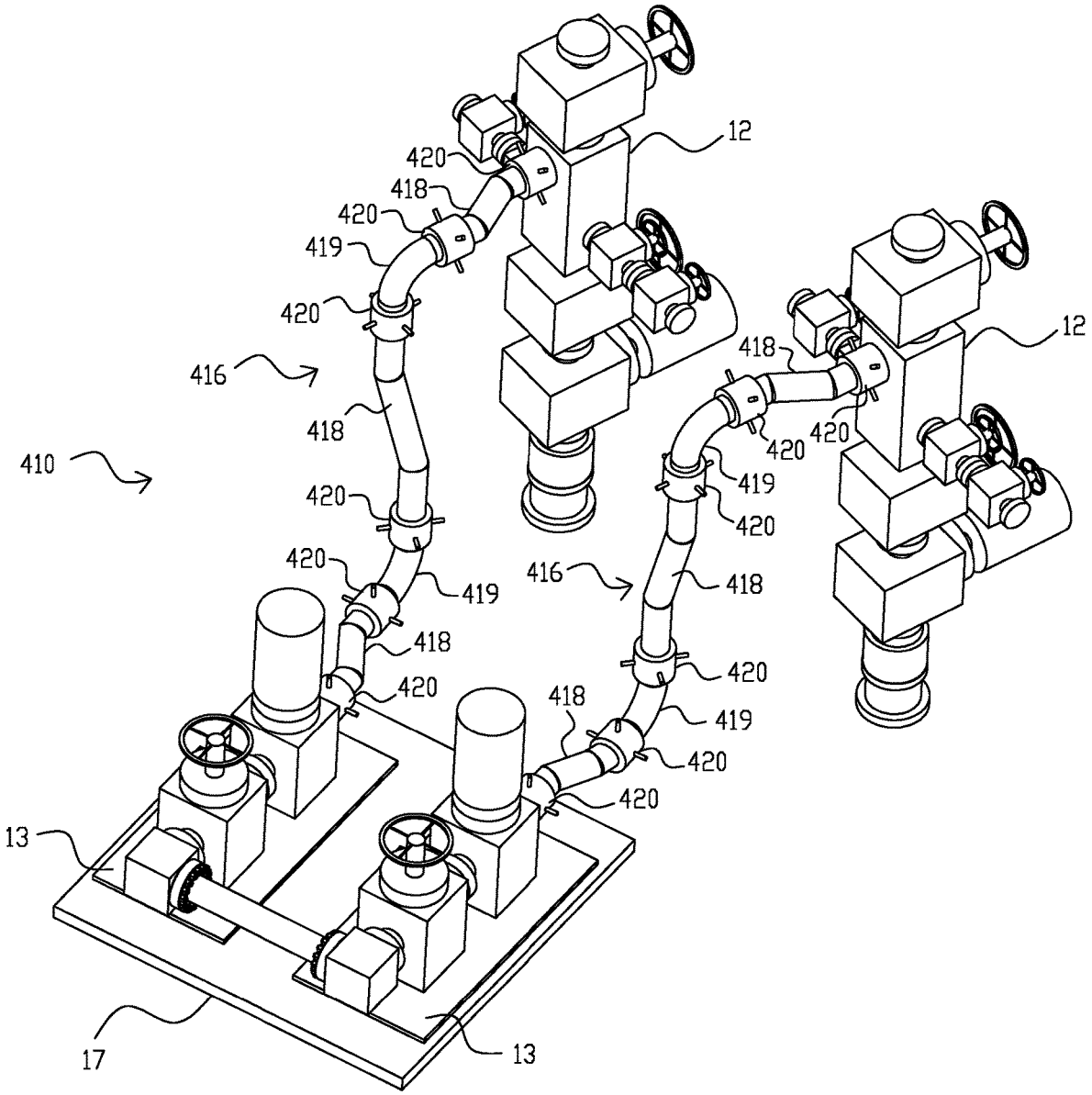
FIG. 8 is a perspective view of an adjustable fracturing system using fracturing fluid conduits composed of offset pipe sections with threaded union end connectors and threaded union angled connectors, in accordance with an embodiment of the present disclosure.

Referring to FIG. 8, shows a perspective view of the an adjustable fracturing system 410 with threaded union end connectors 420. The adjustable fracturing system 410 is substantially identical to the adjustable fracturing system 210 in FIG. 6, except the adjustable fracturing system 410 includes fracturing fluid conduits 416 with a number of threaded union end connectors 420 that allow the offset pipe sections 418 and threaded union angled connectors 419 to rotate with respect to one another, which provides directional movement to the offset pipe sections 418 and thereby provides adjustment to the fracturing fluid conduit 416 to couple the platform 17 mounted fracturing flow control unit 13 to the fracturing tree 12.

Figure 9:
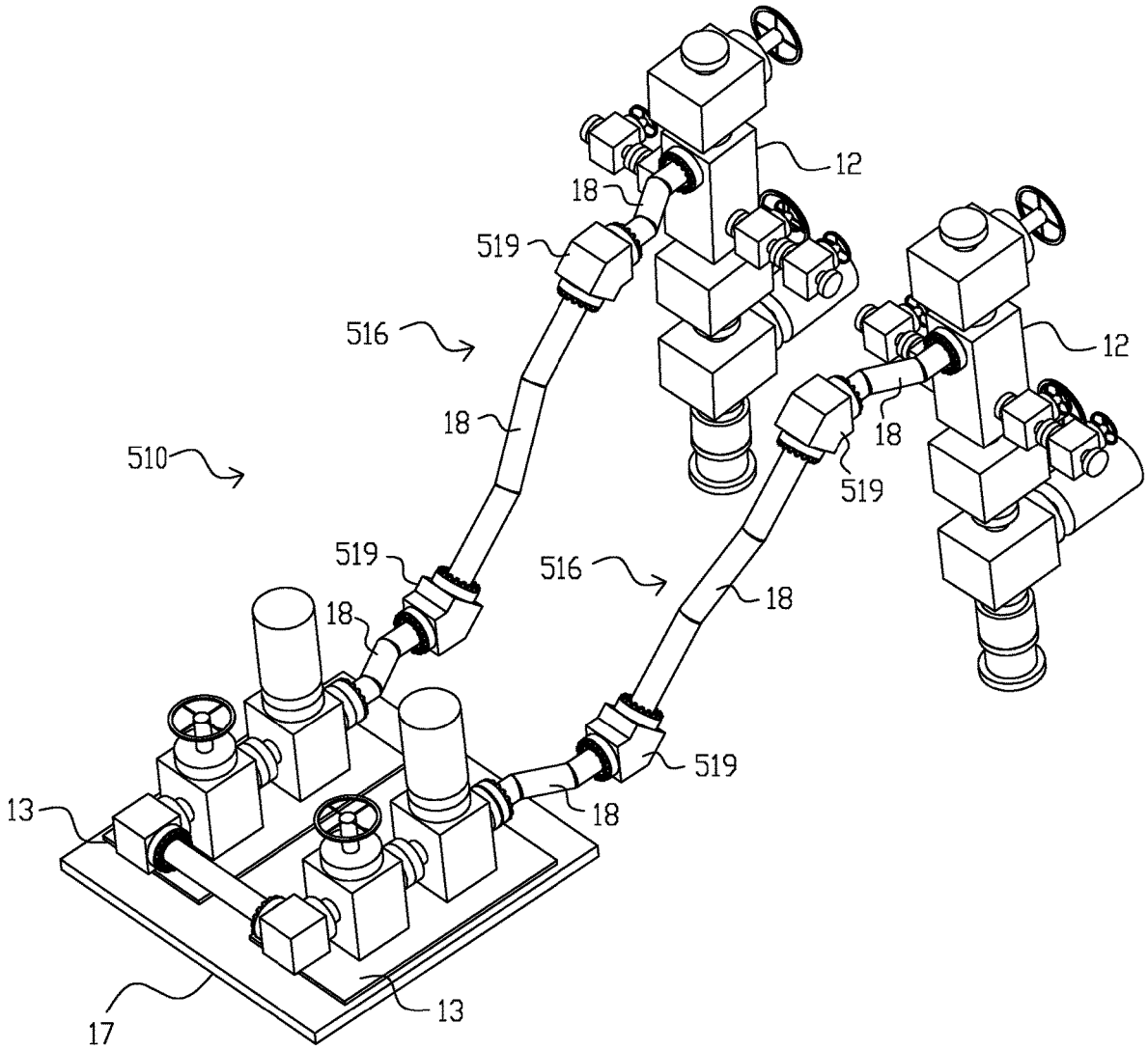
FIG. 9 is a perspective view of an adjustable fracturing system using fracturing fluid conduits composed of offset pipe sections with threaded flange end connectors and greater than ninety degree angled connectors, in accordance with an embodiment of the present disclosure.

Referring to FIG. 9, shows a perspective view of the an adjustable fracturing system 510 with a number of 135 degree angled connectors 519. The adjustable fracturing system 510 is substantially identical to the adjustable fracturing system 10 in FIG. 1, except the adjustable fracturing system 510 includes fracturing fluid conduits 516 with a number of 135 degree angled connectors 519 that couple the offset pipe sections 18 together. The offset pipe sections 18 can be rotated with respect to one another, which provides directional movement to the offset pipe sections 18 and thereby provides adjustment to the fracturing fluid conduit 516 to couple the platform 17 mounted fracturing flow control unit 13 with the fracturing tree 12. The use of a number of 135 degree angled connectors 519 in the fracturing fluid conduit 516 increases the flow efficiency of fracturing fluid through the fracturing fluid conduit 516, resulting in reduced erosion on component parts due to the removal of any ninety degree directional changes in the fluid path.

Figure 10:
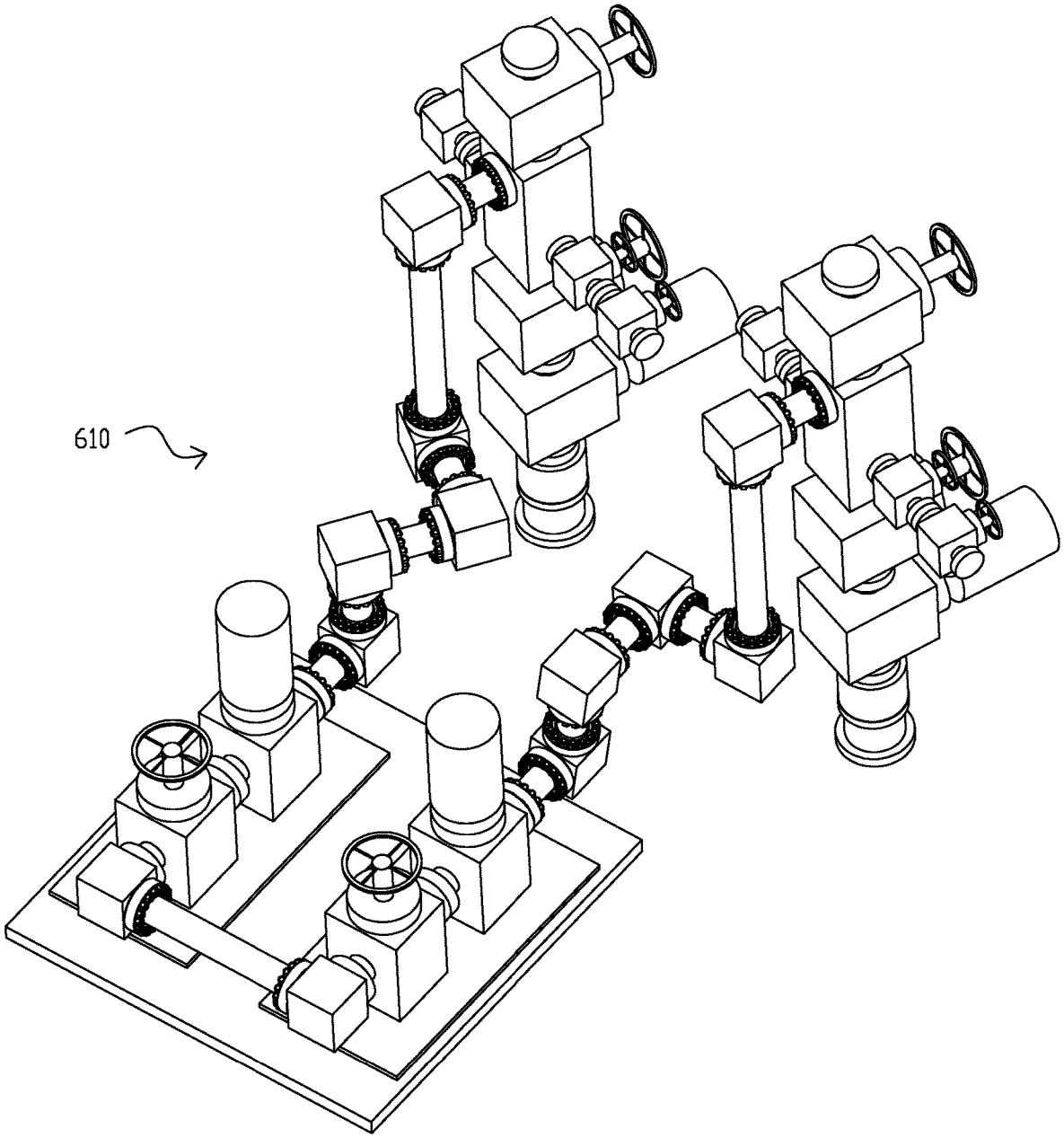
FIG. 10 PRIOR ART
FIG. 10 is a perspective view of a prior art adjustable fracturing system.

Referring to FIG. 10, shows a perspective view of the adjustable fracturing system 610, which illustrates the fracturing system described in the '450 patent and constitutes prior art.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is therefore indicated by the appended claims rather than by the foregoing description. All changes that come within the meaning and range of equivalency of the claims are embraced to be within their scope.

The invention claimed is:

1. A system comprising:

a fracturing flow control unit;

a fracturing tree; and a fracturing fluid conduit coupled between the fracturing flow control unit and the fracturing tree to enable receipt of fracturing fluid by the fracturing tree from the fracturing flow control unit, wherein the fracturing fluid conduit is an adjustable fracturing fluid conduit that allows an operator to vary a dimension of the fracturing fluid conduit to facilitate coupling of the fracturing fluid conduit between the fracturing flow control unit and the fracturing tree, the fracturing fluid conduit includes an offset pipe section that enables freedom of movement in aligning the fracturing fluid conduit between the fracturing flow control unit and the fracturing tree, wherein the offset pipe section has a primary bore having a primary axis and a secondary bore having a secondary axis, wherein the primary bore is parallel to the secondary bore and is directly connected to the secondary bore by an angled bore having a fixed angle.

2. The system of claim 1, wherein the offset pipe section can be rotated about the primary axis causing angular adjustment to the secondary axis, enabling directional adjustment to the offset pipe section.

3. The system of claim 2, wherein the offset pipe section has a rotatable connection on each end.

4. The system of claim 3, wherein the offset pipe section has a first angled connector coupled to one of the rotatable connections.

5. The system of claim 4, wherein a second offset pipe section has one of the rotatable connections on each end, and is coupled to the first angled connector, enabling a secondary axis of the second offset pipe section to rotate with respect to the first angled connector about a primary axis of the second offset pipe section causing angular adjustment to the secondary axis of the second offset pipe section and providing directional adjustment to the second offset pipe section.

6. The system of claim 1, wherein the fracturing fluid conduit coupled between the fracturing flow control unit and the fracturing tree is the only fracturing fluid conduit coupled between the fracturing flow control unit and the fracturing tree that enables receipt of fracturing fluid by the fracturing tree from the fracturing flow control unit.

7. A system comprising a fracturing fluid conduit configured to route fluid from a fracturing flow control unit to a fracturing tree, the fracturing fluid conduit including a plurality of offset pipe sections with rotatable connections on each end of the offset pipe sections that enable rotation of the plurality of offset pipe sections to facilitate positioning of the fracturing fluid conduit between the fracturing flow control unit and the fracturing tree, wherein a first offset pipe section of the plurality of offset pipe sections has a primary bore with a primary axis and a secondary bore with a secondary axis, wherein the primary bore is parallel to the secondary bore and is immediately coupled to the secondary bore by an angled bore having a non-adjustable angle.

8. The system of claim 7, wherein the first offset pipe section with one of the rotatable connections on each end is connected to a second offset pipe section by an angled connector, the first offset pipe section and the second offset pipe section are connected at an angle with respect to one another by the angled connector, wherein the first offset pipe section can be rotated about the primary axis of the first offset pipe section to change the orientation of the secondary axis of the first offset pipe section to provide a freedom of movement to the fracturing fluid conduit.

9. The system of claim 8, wherein the second offset pipe section is connected to the angled connector with one of the rotatable connections.

10. The system of claim 8, wherein the first offset pipe section and second offset pipe section of the fracturing fluid conduit are connected orthogonally to one another by the angled connector.

11. The system of claim 6, wherein the fracturing fluid conduit coupled between the fracturing flow control unit and the fracturing tree is the only fracturing fluid conduit coupled between the fracturing flow control unit and the fracturing tree.

12. A method comprising: positioning a fracturing fluid conduit between a fracturing flow control unit and a fracturing tree, wherein positioning the fracturing fluid conduit includes turning a first offset pipe section of the fracturing fluid conduit with respect to a second offset pipe section of the fracturing fluid conduit to extend or retract the fracturing fluid conduit between the fracturing flow control unit and the fracturing tree, wherein the first and second offset pipe sections are connected to one another via an angled connector and turning the first offset pipe section with respect to the second offset pipe section includes moving the angled connector and second offset pipe section at an angular dimension with respect to a primary axis of the first offset pipe section, wherein the first offset pipe section has a primary bore parallel to a secondary bore of the first offset pipe section, wherein the primary bore is directly affixed to the secondary bore by an angled bore having a non-variable angle connecting the fracturing fluid conduit between a fracturing flow control unit and a fracturing tree.

13. The method of claim 12, comprising assembling the fracturing fluid conduit with connections that enable sections of the fracturing fluid conduit to rotate with respect to one another.

14. The method of claim 13, comprising fracturing a well through the fracturing tree with fracturing fluid routed from the fracturing flow control unit via the fracturing fluid conduit.

* * * * *